United States Patent [19]

Mortensen

[11] 4,322,985

[45] Apr. 6, 1982

[54] ENGINE STARTER WITH AN OVERRUNNING CLUTCH DEVICE

[75] Inventor: Harold R. Mortensen, Horseheads, N.Y.

[73] Assignee: Facet Enterprises, Inc., Tulsa, Okla.

[21] Appl. No.: 132,012

[22] Filed: Mar. 20, 1980

[51] Int. Cl.[3] ..... F02N 15/06; F16D 43/06

[52] U.S. Cl. ..... 74/6; 192/106 R; 192/114 R

[58] Field of Search ..... 74/6, 7 R, 7 A; 192/114 R, 106 R

[56] References Cited

U.S. PATENT DOCUMENTS

| | | | |
|---|---|---|---|
| 2,554,445 | 5/1951 | Miller | 74/6 |
| 3,090,242 | 5/1963 | Sabatini | 74/7 |
| 3,263,509 | 8/1966 | Digby | 74/6 |
| 3,646,820 | 3/1972 | Vogel et al. | 74/6 |
| 3,915,020 | 10/1975 | Johnson | 74/6 |
| 4,114,746 | 9/1978 | Usui | 74/6 X |

*Primary Examiner*—Allan D. Herrmann

*Attorney, Agent, or Firm*—Remy J. VanOphem

[57] ABSTRACT

An engine starter gear of the positive shift type has a clutch to provide driving, indexing, means for keeping the clutch teeth in engagement during the indexing function, and a centrifugal separator to separate clutch teeth in an overrunning condition. The separator includes spherical members retained in an annular retainer member, which spherical members move radially outward of the shaft as the engine accelerates to transmit axial thrust against an inclined surface on an annular ring member to displace the driving clutch member from the driven clutch teeth. The axial thrust on the annular ring member causes separation of the clutch teeth in an overrunning or overspeed condition.

10 Claims, 7 Drawing Figures

ENGINE STARTER WITH AN OVERRUNNING CLUTCH DEVICE

BACKGROUND OF THE INVENTION

1. Field of the Invention

The present invention relates to engine starters for internal combustion engines and more particularly to starters of the positive shift type which include a dentil clutch to provide driving and overrunning functions and more specifically a centrifugal separator for effecting the automatic separation of the dentil clutch teeth after the engine becomes self-running to prevent torque transmission in the overspeed or overrunning condition.

2. Description of the Prior Art

As is well known in the prior art, an engine starter normally includes a starter motor, a drive pinion slidably mounted on an output shaft thereof for meshing engagement with the ring gear of an engine. In addition, the starter has an overrunning clutch to permit the engine to start and accelerate under its own power without driving the starter motor shaft at excessive speeds. The purpose of the overrunning clutch is to break the driving connection between the drive pinion and the starter motor. The overrunning clutch thus prevents abuse by extended periods of overrun at high speeds when the attendant neglects to disengage the starter after the engine has become self-running, thereby causing the engine to drive the starter motor.

In some prior art starters, for example, U.S. Pat. No. 3,263,509, owned by the assignee of the present patent application, centrifugal separators of the type using arcuate flyweight members annularly arranged have been used to effectuate separation of the dentil teeth upon occurrence of an overrunning condition. A centrifugal separator of this type has resulted in manufacturing problems during assembly due to the fact that the arcuate flyweight elements must be held in position through the use of grease lubricant while the various other details of the starter are assembled. This has resulted in a time consuming process to assemble the arcuate flyweight members within the starter mechanism. In addition, in operation, the frictional forces between the inclined surfaces of the arcuate flyweight members and the inner inclined surface that these elements contact generate excessive localized heat upon long periods of overrunning of the clutch. This results in the arcuate flyweight members locking up against the inclined surface of the thrust washer making the separator ineffective. This causes excessive wear on the dentil teeth over a long period of time, thereby reducing the useful life of the starter gearing. In order to overcome this problem, larger flyweight members were required to cause separation of the clutch teeth so as to overcome the localized heat problem. Due to the physical size of the larger flyweight members, the use of this prior art design has been precluded in small drive applications.

A significant improvement was obtained in the useful life of prior art starters utilizing centrifugal separators characterized by a plurality of spherical weight members held by a biasing member. For example U.S. Pat. No. 3,915,020, owned by the assignee of the present patent application, and U.S. Pat. No. 4,114,746. In the prior art designs, a set of spherical centrifugal weights are mounted on radially flexible resilient arms which are held in rolling contact with a tapered angular guide surface to force the angular guide surface and hence the driving clutch member away from the driven clutch member. The spherical weights generate this centrifugal separating force as the spherical weights move radially outward when the speed of rotation of the engine overruns the starter shaft. These designs, however, require the use of larger spherical weights to cause separation of the clutch teeth when the speed of rotation exceeds a predetermined speed since the centrifugal force of the weights must overcome the spring force of the biasing arms before separation occurs. The use of larger spherical flyweights also precludes its use in small drive applications.

However, neither U.S. Pat. No. 3,915,020 nor U.S. Pat. No. 4,114,746 completely eliminated the difficult assembly techniques required to assemble the spherical weight members on the biasing arms into the starter gearing, nor have they reduced significantly the cost of assembling of the starter. Furthermore, none of the aforementioned prior art designs have been able to reduce the physical size of the separator members to permit the use of these designs in small drive applications.

BRIEF SUMMARY OF THE INVENTION

This invention provides an engine starter of the positive shift type that permits rotation of the engine gear to centrifugally separate the dentil teeth when the pinion rotates at a speed faster than the starter motor shaft. The separator permits the use of a centrifugal separator in substantially smaller drive gear applications than currently permitted in known prior art designs. Furthermore, the separator is very compact and permits the assembly of the separator details to the pinion in a manner that has eliminated the difficult assembly techniques previously known in prior art devices thereby reducing significantly the cost of assembly of the separator means.

The invention is an engine starter gear assembly with an improved centrifugal separator including a plurality of spherical members whereby the centrifugal separator separates the clutch teeth when the starter is in the overrunning condition.

The starter gear with a rotatable shaft has a sleeve member slidably and nonrotatably mounted to the shaft with the sleeve having a first outer diameter with an external helical spline. A pinion gear is slidably mounted on the shaft for axial movement relative to the shaft. The pinion gear is further adapted for movement into and out of engagement with the ring gear of an engine to be started. A driving clutch member is slidably mounted on the helical splines of the sleeve member. An annular driven clutch member is integral with the pinion gear so as to be slidably mounted on the shaft between the pinion gear and the driving clutch member. The driving member further has clutch teeth which are mutually engagable with teeth on the driven member so as to transmit torque between the driving and driven clutch members in one direction of relative motion. A closed end of a barrel housing is slidably mounted on the sleeve member with the barrel housing enclosing the driving and driven clutch members therein. The engine starter gear further has a lock ring mounted within the barrel housing adjacent to the open end for engaging the driven clutch member to confine the driving and driven clutch members within the housing. In addition, a biasing member is also provided within the housing adjacent the closed end and abutting the driving clutch member for biasing the clutch members into engagement within the housing. Finally, the starter gear has a centrifugal separator assembly which is mounted within mutual counterbores in the driven and driving members. The separator centrifugally separates the driving member in a direction away from the driven member when the driven member rotates in an overrunning condition. The separator assembly includes an annular ring member having an inclined surface. The annular ring member is mounted within the counterbore of the driving clutch member. The separator assembly also includes an annular retainer member which is secured to the counterbore in the driven clutch member and mounted adjacent to the annular ring member. The annular retainer member also has a plurality of radial recesses formed therein into which a plurality of spherical members are disposed. When the driving clutch member is in an overrunning condition, the spherical members move radially outward against the inner inclined surface on the annular ring member to cause the driving clutch member to move axially in a direction away from the driven clutch member so that the clutch teeth separate and disengage.

Accordingly, it is a primary object of this invention to provide an engine starter gear that uses mutually engageably inclined torque transmitting clutch teeth during indexing of the pinion gear with respect to the engine ring gear and to provide a positive type of overriding clutch with a centrifugal separator with spherical members for disengaging the clutch teeth completely when the engine overruns the power shaft speed which can be used in small pinion application.

It is another object of the present invention to provide a starter gear for use with small pinion applications which is efficient, reliable, and economical to manufacture.

It is a still further object of the present invention to provide a starter gear that prevents adverse damage to the clutch teeth on the driven and driving clutch members and which can be used in small pinion application.

It is still a further object of the present invention to provide a starter gear for small pinion applications which includes a positive type of overriding clutch with a centrifugal separator for holding the clutch teeth disengaged during overrunning of the engine above the power shaft speed and which utilizes a form of construction which is adaptable to low cost manufacturing and low cost assembling techniques.

It is still another object of the present invention to provide an improved starter drive having a centrifugal separator with spherical members for separating the clutch after engine start-up to prevent long periods of clutch overrunning and which is adaptable to small pinion applications.

The above and other objects and teachings of the invention will become apparent in the following detailed description taken from the drawings and claims which form a part of the specification.

DETAILED DESCRIPTION OF THE PREFERRED EMBODIMENT

Figure 1:
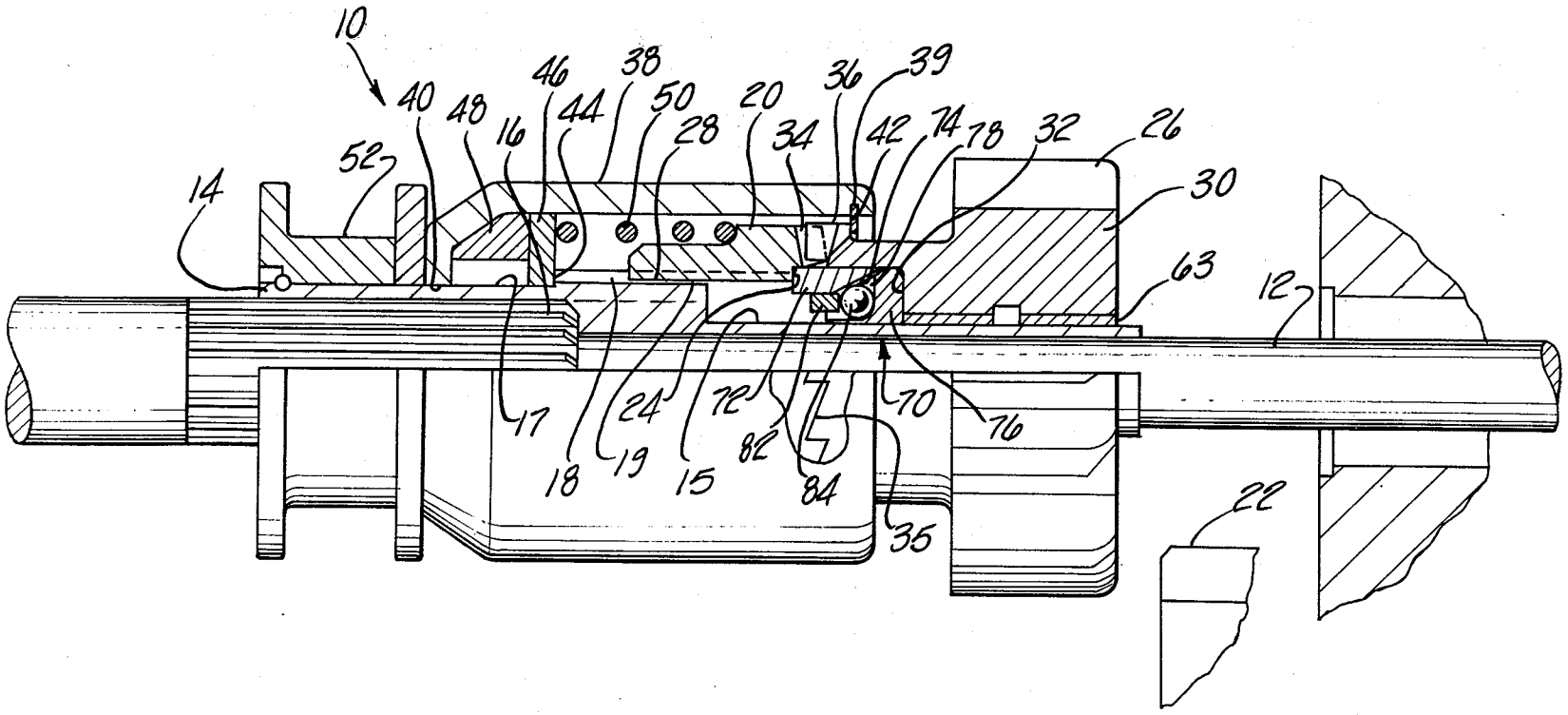
FIG. 1 is a sectional view of an engine starter of the preferred embodiment according to the principles of the present invention.
Figure 2:
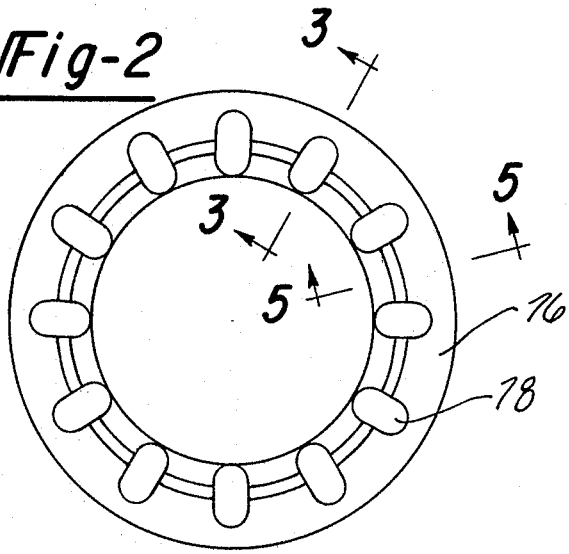
FIG. 2 is a planar view of the annular retainer member of the preferred embodiment showing the plurality of recesses formed therein.

Referring to FIG. 1, there is illustrated a starter gear, generally designated by the numeral 10, for an engine. The starter drive is mounted on a power shaft 12 of a starting motor (not illustrated). The starter gear includes an axially extending sleeve member 14 which is connected to the power shaft 12 by straight splines 16 so as to be axially but nonrotatably movable relative to the power shaft. The outside surface of the intermediate portion 19 of the sleeve member 14 has helical splines 18 formed thereon. A driving clutch member 20 with a first end portion which includes mutually engageable helical splines 28 on its innermost diameter is slidably and rotatably mounted on the helical splines 18 on the sleeve member 14. The opposite end portion of the driving clutch member has axially extending clutch teeth 34 which are coaxially disposed with respect to the sleeve member 14 and the power shaft 12. The opposite end portion of the driving clutch member has a counterbore 24 for a purpose to be described later herein.

A pinion gear 26 is slidably journalled on a bearing 63 which is in turn mounted on the first outer diameter 15 of the sleeve 14. The pinion gear 26 is adapted to move axially along the power shaft for movement into and out of engagement with the engine gear 22 of the engine to be started (not shown). An annular driven clutch member 30 is integrally formed with the pinion gear at one end portion so as to extend axially from the pinion gear for cooperative engagement with the driving clutch member. The opposite end portion of the driven clutch member 30 has an axially extending clutch teeth 36 which cooperatively engage the driving clutch teeth 34. The clutch teeth 34, 36 are provided with mutually engageable inclined torque transmitting surfaces 35. The clutch teeth 34, 36 are of the saw tooth variety to provide a unidirectional overrunning clutch connection between the driven clutch member 30 and the driving clutch member 20. The opposite end portion of the driven clutch member further has a counterbore 32 for a purpose to be described later herein.

A barrel shaped housing 38 has a closed end 40 and an opposite end portion coaxially aligned with respect to the closed end. The closed end 40 is mounted onto the second outer diameter 17 of the sleeve member 14. A lock ring 42 is seated in an annular groove 39 adjacent to the opposite end portion of the housing 38. The barrel shaped housing extends axially a predetermined length so as to confine the driving 20 and driven 30 clutch members within the housing cavity.

The sleeve member 14 is formed with a radial shoulder 44 which is formed between the helical splines 18 and the second outer diameter 17 on the sleeve member 14. The radial shoulder 44 provides an axial abutment for an abutment member or washer 46 which is mounted on the sleeve member 14. A resiliently yieldably cylinder member 48, preferably of an elastically deformable material, such as rubber, is compressably confined between the washer 46 and the closed end 40 of the housing 38. A resilient biasing member 50 is compressably confined between the abutment member and the driving clutch member 20 to provide a biasing force to urge the clutch teeth 34, 36 into an engaged position.

The starter gear assembly 10 is moved axially along the power shaft into and out of engagement with the engine gear 22 by any well known solenoid, air or hydraulic cylinder actuated lever (not shown). The lever is connected to the shaft collar 52 which is secured to the second outer diameter 17 of the sleeve member 14 and connected adjacent to the closed end 40 of the barrel shaped housing 38.

Figure 5:
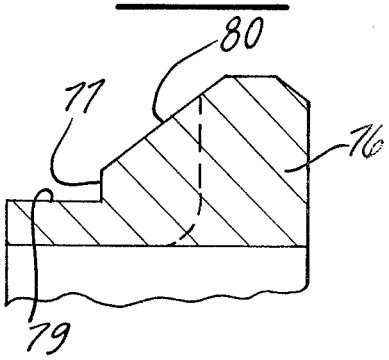
FIG. 5 is a partial sectional view along 5—5 of FIG. 2.
Figure 3:
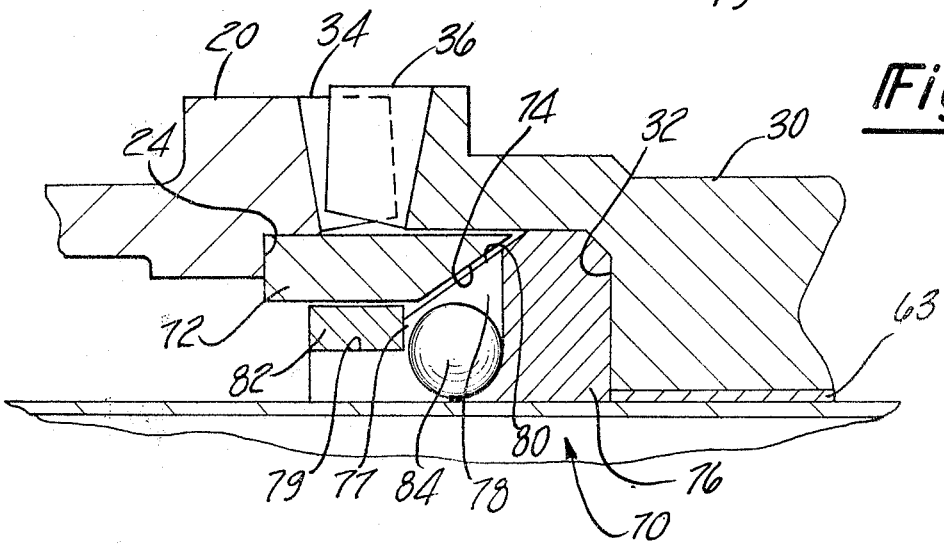
FIG. 3 is a detailed sectional view of the engaged clutch teeth of the driving and driven clutch members and a sectional view taken along section 3—3 of FIG. 2 of the separator assembly of the preferred embodiment before the driven member rotates above a predetermined speed.
Figure 4:
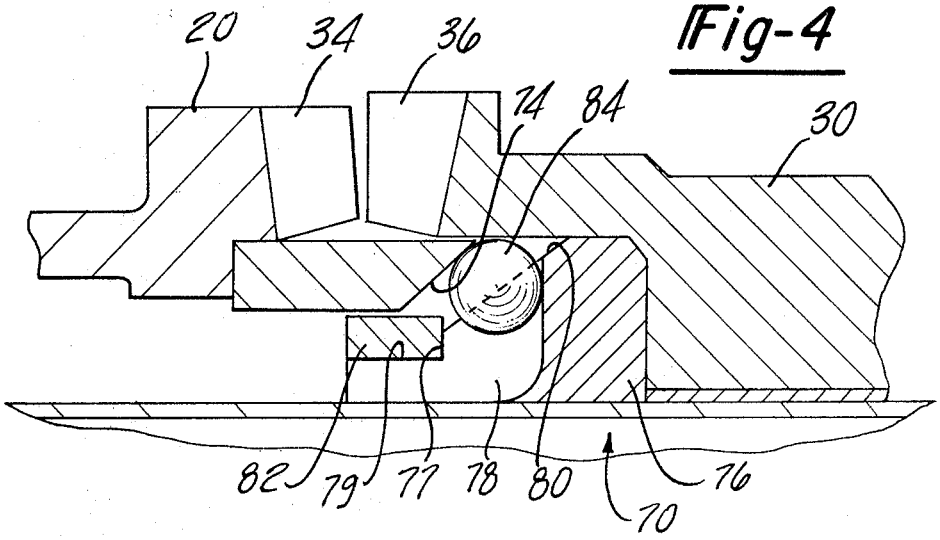
FIG. 4 is a detailed sectional view of the starter gear with the separator assembly of the preferred embodiment showing the clutch teeth of the driving and driven members separated when the starter gear engages the ring gear and the engine overruns the starter.

The separation of the driven clutch member 30 and the driving clutch member 20 during an overrunning condition is accomplished by a separator assembly generally designated by the numeral 70 which is mounted within the counterbores 24, 32. The separator assembly 70 comprises four parts: an annular ring member 72, an annular retainer member 76, spherical members 84 and a ring member 82. An annular ring member 72 is coaxially disposed with the power shaft 12 with one end mounted in the counterbore 24. At the opposite end, the inner diameter of the annular ring member 72 also has a radially inclined surface 74 which tapers outwardly with respect to the longitudinal axis of the starter shaft toward the pinion gear. An annular retainer member 76 is slidably mounted on the first outer diameter 15 of the sleeve 14 and mounted to the driving clutch member 30 by securing the member 76 at one end into the counterbore 32. The annular retainer member 76 has a radially inclined surface 80 opposing the inclined surface 74 of the annular ring member 72 as shown in FIGS. 2, 3, 4, and 5. A plurality of radial recesses 78 are formed into surface 80. The retainer member 76 has a cylindrical outer surface 79 terminating in a shoulder 77 which is radially disposed with respect to the power shaft 12. A plurality of spherical members 84 are annularly disposed within the radial recesses 78 and are retained to prevent axial movement within the retainer member by the ring member 82. The ring member 82 is secured to the cylindrical surface 79 so that one end abuts the radial shoulder 77 on the retainer member 76. The ring member 82 permits the spherical members 84 to move radially in a direction away from the power shaft 12 but prevents axial movement within the retainer member as is shown in FIGS. 3, 4, and 5.

In operation, when it is desired to start the engine, the starter assembly 10 is shifted axially toward the engine ring gear 22 by a positioning mechanism (not shown) connected to the collar 52. The starter gear assembly 10 is moved along the power shaft 12 so that the pinion gear 26 engages the engine ring gear 22. The starter gear 10 also has an indexing function in the event that the pinion gear 26 abuts one of the teeth of the engine ring gear 22 which will be described later. The power shaft 12 is rotated by a starting motor (not shown) to transmit torque through the straight splines 16 to sleeve member 14, through the helical splines 18, through the helical splines 28 on the driving clutch member 20, through the mutually engageable clutch teeth 34, 36, through the driven clutch 30, through the pinion gear 26 and then to the engine gear 22. After the engine starts and becomes self-operating, the engine gear 22 will drive the pinion gear 26 at a speed greater than that of the power shaft 12, that is in an overrunning condition.

As the engine accelerates, the separator assembly becomes operative in that the spherical members 84 are moved by centrifugal force radially outward of the power shaft 12, as guided by the recesses 78 in the annular retainer member 76 and by the ring member 82. As the spherical members 84 move radially outward, they engage the inclined surface 74 of the annular ring member 72 so as to transmit an axial thrust which urges the driving clutch member away from the driven clutch member. Thus, the spherical members 84 cause the driving clutch member 20 to move axially along the power shaft 12 against the biasing force of spring 50, causing the separation of clutch teeth 34, 36 in the overrunning condition. The action of the separator assembly prevents the clutch teeth from being subjected to long periods of contact while the pinion is in an overrunning condition.

The starter is further designed to provide an indexing function when the pinion gear 26 abuts one of the teeth of the engine ring gear 22 when the starter is actuated into engagement with the engine ring gear. When an abutment occurs, the axial movement by the driven member along the power shaft is obstructed by the ring gear tooth engagement with a pinion gear tooth. However, the positioning mechanism will continue to shift the housing 38 and sleeve member 14 axially along the power shaft toward the engine ring gear 22. In this abutment condition, the pinion gear and the driven and driving clutch members cannot move axially along the power shaft to engage the engine ring gear. However, the sleeve 14 and the housing 38 will continue to shift axially along the power shaft 12 toward the engine ring gear 22. This continued axial movement of sleeve member 14 and housing 38 along shaft 12 toward the engine ring gear 22 forces the driving clutch member 20 to rotate on the helical splines 18, 28. This rotation of the driving clutch member 20 is transmitted to the driven clutch member 30 and the pinion 26 through the clutch teeth 34, 36 so that the pinion will clear the obstructing tooth on the engine ring gear 22. As the tooth is cleared, the spring 50 snaps the pinion gear 26 and the driven and driving clutch members axially along the power shaft so that the pinion gear 26 engages the engine ring gear 22.

Figure 6:
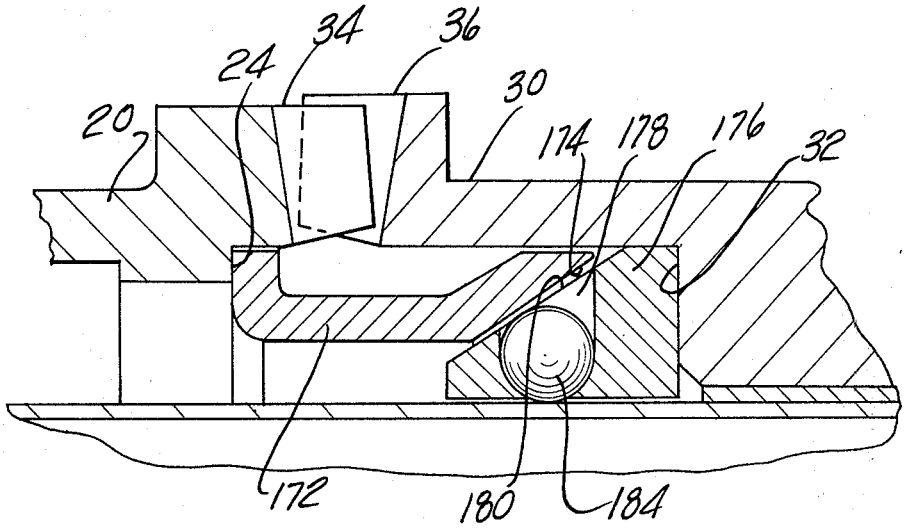
FIG. 6 is a detailed sectional view of the clutch teeth of the driven and driving clutch members with the separator assembly of an alternate embodiment before the driven member rotates above a predetermined speed.
Figure 7:
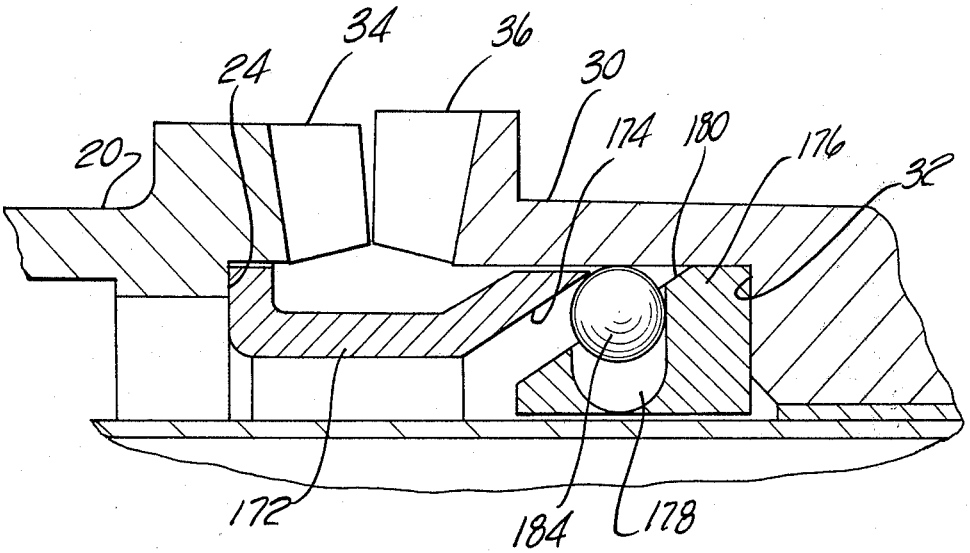
FIG. 7 is a detailed sectional view of the clutch teeth of the driven and driving clutch members with the separator assembly of the alternate embodiment showing the clutch teeth separated.

In an alternate embodiment of the invention as shown in FIGS. 6 and 7, the separator assembly comprises 3 members: an annular ring member 172, an annular retainer member 176, and a plurality of spherical members 184. The annular ring member 172 is coaxially disposed with the power shaft 12 with one end mounted in the counterbore 24 of the driving clutch member 20. At the opposite end, the inner diameter of the annular ring member 172 also has a radially inclined surface 174 which tapers outwardly with respect to the longitudinal axis of the starter shaft 12 toward the pinion gear. The annular retainer member 176 is slidably mounted on the first outer diameter 15 and is coaxially disposed with the shaft 12 with one end secured in the counterbore 32 of the driving clutch member 30. The annular retainer member 176 has a radially inclined surface 180 opposing the radially inclined surface 174 of the annular ring member 172. A plurality of radial recesses 178 are formed into surface 180 of the annular retainer member 176 as is shown in FIGS. 6 and 7. A plurality of spherical members 184 are annularly disposed within the radial recesses 178. Thus, the spherical members move radially in a direction away from the power shaft 12. Axial movement of spherical members is prevented by the radial recesses as shown in FIGS. 6 and 7.

The operation of this alternate embodiment of the invention is essentially the same as in the preferred embodiment except that the plurality of spherical members 184 tend to move radially outward of the shaft 12 as the shaft rotates in the overrunning condition. The spherical members 184 are guided radially outward by the recesses 178 in the annular retainer member 176. As the spherical members 184 move radially outward, they engage the inclined surface 174 of the annular ring member 172 so as to transmit an axial thrust. This axial thrust urges the driving clutch member away from the driven clutch member to cause separation of the clutch teeth.

While two embodiments of the invention have been disclosed, it will be apparent to those skilled in the art that changes may be made to the invention as set forth in independent claims, and in some cases, certain features of the invention may be used to advantage without corresponding use of other features. Accordingly, it is intended that the illustrative and descriptive materials herein be used to illustrate the principles of the invention and not to limit the scope thereof.

What I claim is:

1. An engine starter having a shaft comprising:

a sleeve member slidably and nonrotatably mounted to said shaft, said sleeve member having one end portion, an opposite end portion and an intermediate portion interposed said one end portion and said opposite end portion, said one end portion having a first outer diameter, said opposite end portion having a second outer diameter larger than said first outer diameter and said intermediate portion having helical splines formed thereon;

a pinion gear slidably journalled on said first outer diameter of the sleeve member for axial movement relative to said shaft, said pinion gear further adapted for movement into and out of engagement with the gear of the engine to be started;

a driving clutch member coaxially disposed with said shaft, said driving clutch member having one end and an opposite end, said one end portion having axially extending dentil clutch teeth, said opposite end being slidably mounted on said helical splines of the sleeve member;

an annular driven clutch member slidably mounted on said first outer diameter of the sleeve member and interposed said pinion gear and said driving clutch member, said annular driven clutch member having a first end secured to said pinion gear, and a second end opposite said first end, said second end having axially extending dentil clutch teeth to engage said clutch teeth on said driving member, said clutch teeth on said driving and driven clutch members further having inclined complimentary mutually engageable inclined teeth for transmitting torque between said driving and driven clutch members in one direction of relative rotation; and means, mounted on said first outer diameter on said sleeve and interposed said driving clutch member and said driven clutch member, for centrifugally separating said driving member in a direction away from said driven member when said driven member rotates above a predetermined speed, said centrifugal separating means further comprising:

an annular ring member abutting said driving clutch member, said annular ring member having an inner radially inclined surface;

an annular retainer member secured to said driven clutch member and mounted adjacent said annular ring member, said annular retainer member having a plurality of recesses formed therein;

a plurality of spherical members annularly disposed in said recesses of said annular retainer member whereby said spherical members move radially in a direction outward from said shaft to move against said inner inclined surface on said annular ring member to cause said driving clutch member to move in a direction away from said driven clutch member and to separate and disengage said clutch teeth on the driving clutch from said clutch teeth on the driven clutch member; and a ring member mounted to said annular retainer member for guiding said plurality of spherical members within said annular retainer member and for preventing said spherical members from moving axially within said annular retainer member.

2. An engine starter as claimed in claim 1, further comprising:

a barrel housing having an open end and a closed end opposite said open end, said closed end slidably mounted on said second outer diameter on said sleeve, said barrel housing further extending axially so as to spatially enclose said driving and driven clutch members; and abutment means, mounted within said housing adjacent to said open end, for engaging said driven clutch member within said housing and for confining said driving and driven clutch members within said housing.

3. An engine starter as claimed in claim 2, further comprising;

resilient means, mounted within said housing adjacent said closed end and abutting said driving clutch member, for biasing said driving clutch member into engagement with said driven clutch member.

4. An engine starter as claimed in claim 3 further comprising:

means for providing axial movement of said driving clutch members and of said driven clutch member so as to engage said pinion gear with the engine gear to be rotated.

5. An engine starter as claimed in claim 4 wherein said separator means further comprises:

means for biasing said spherical members radially inwardly such that said biasing means is operative to cause said spherical members to return to the position attained by said spherical members prior to the centrifugal separation of said driven and driving clutch members.

6. In combination with an internal combustion engine of the type having a gear for starting the rotation of the engine crankshaft and a starter for rotating said gear, said starter comprising a rotatable power shaft; an elongated sleeve member, coaxially and slidably mounted on said power shaft, said elongated sleeve member further adapted to engage and rotate with said power shaft, a driven clutch member coaxially and slidably mounted on said elongated sleeve member, said driven member having radially extending gear teeth on the other end, a driving clutch member coaxially and slidably mounted on said elongated sleeve member, said driving member having axially extending clutch teeth on one end which includes surfaces engageable with said driven member clutch teeth for transmitting torque in one direction between said driven and driving clutch members, means for keeping the clutch teeth of said driven clutch member in engagement with the clutch teeth of said driving member when said driving member moves in a direction toward said driven clutch member, and means for separating the clutch teeth of said driven member from the clutch teeth of said driving member such that said driving clutch member moves in a direction away from said driven clutch member when said driven clutch member rotates above a predetermined speed, wherein the improvement in said means for separating the clutch teeth further comprises:

an annular ring member abutting said driving clutch member, and mounted coaxially with respect to said elongated sleeve member, said annular ring member having an inner inclined surface;

an annular retainer member secured to said driven clutch member and mounted adjacent said annular ring member, said annular retainer member further having a plurality of radial recesses formed therein;

a plurality of spherical members annularly disposed in said recesses of said annular retainer member; and a ring member mounted to said annular retainer member for guiding said spherical members in said recesses of said annular retainer member such that when said driven clutch member rotates above said predetermined speed, said spherical members move radially outward to move against said inner inclined surface on said annular ring member thereby causing said driving clutch member to move in a direction away from said driven clutch member and to separate and disengage said clutch teeth when said driven clutch member rotates at a speed above said predetermined speed.

7. The starter gear combination as claimed in claim 6, further comprising:

means for biasing said spherical members radially inwardly such that said biasing means is operative to cause said spherical members to return radially to the position attained by said spherical members in said recesses of said retainer member prior to the centrifugal separation of said driven and driving clutch members.

8. An overrunning clutch device in an engine starter including a starter motor having an output shaft, a sleeve member slidably and coaxially mounted on said output shaft for rotation therewith, a pinion gear slidably mounted on said sleeve member for meshing engagement with the ring gear of an associated engine for rotation therewith, the overrunning clutch comprising:

an annular driven clutch member coaxially mounted on said sleeve member, said driven clutch member having one end secured to the pinion gear, and an opposite end having axially extending dentil type clutch teeth, said annular driven clutch member further having an annular counterbore extending axially along said sleeve member in the direction of said axially extending clutch teeth;

a driving clutch member coaxially mounted on said sleeve member and adjacent to said driven clutch member, said driving clutch having a first end portion being slidably but nonrotatably mounted to said sleeve member, and a second end portion having axially extending dentil type clutch teeth to engage said clutch teeth on said opposite end of said driven clutch member, said driving clutch member further having a second counterbore extending axially along said sleeve member in the direction toward said driven member;

biasing means for urging said clutch teeth on said driving clutch member into driving engagement with said clutch teeth on said driven clutch member; and means for separating said clutch teeth on said driving clutch member from said clutch teeth on said driven clutch member by moving said driving clutch member in an axial direction away from said driven clutch member when said driven clutch member rotates above a predetermined speed, said separating means comprising:

an annular ring member abutting said driving member, said annular ring member having a first end mounted in said second counter bore of the driving member, a second end opposite said first end, and an inner radially inclined surface tapered from said second end toward said first end;

an annular retainer member abutting said driven member, said retainer member having a first end portion secured in said counterbore of the driven member, a second end portion opposite said first end portion, a first outer diameter adjacent to said first end portion, a second outer diameter adjacent to said second end portion with said second outer diameter further being smaller than said first outer diameter, an outer radially inclined surface tapered from said first outer diameter toward said second outer diameter, a plurality of radial recesses formed in said outer inclined surface, said outer radially inclined surface cooperating with said inner radially inclined surface of said first annular ring member;

a plurality of spherical members disposed within said plurality of radial recesses; and a ring member secured to said second outer diameter on said annular retainer member for guiding said spherical members within said annular retainer member, said ring member further being disposed adjacent to the inner diameter of said annular ring member, whereby when said driven clutch member is caused to rotate above said predetermined speed, each of said plurality of spherical members move radially outwardly of said radial recess in said retainer member against said inner radially inclined surface of said annular ring member to move said annular ring member and said driving clutch member in a direction away from said driven clutch member so as to disengage said clutch teeth on said driving clutch member from said driven clutch member and when said driven clutch member rotates at a speed below said predetermined speed, said spherical members return within said radial recesses and said biasing means causes said clutch teeth of said driving clutch member to engage said clutch teeth of said driven clutch member.

9. The clutch device of claim 8 further comprising:

means for providing axial movement of said driving clutch member and of said driven clutch member so as to engage the drive pinion with the ring gear of the engine for rotation therewith.

10. The clutch device of claim 9 further comprising:

indexing means for shifting said driving and driven clutch members and the pinion gear into engagement with and toward said ring gear of the engine to be rotated when the pinion gear abuts the ring gear and an obstructing tooth on the ring gear prevents engagement of the pinion gear with the ring gear.

* * * * *